United States Patent [19]

Cooper

[11] 3,957,396

[45] May 18, 1976

[54] PRESSURE CONTROL IN HYDRAULIC SYSTEMS

[75] Inventor: John Edwin Cooper, Leatherhead, England

[73] Assignee: Sperry Rand Limited, London, England

[22] Filed: Oct. 9, 1973

[21] Appl. No.: 404,742

[30] Foreign Application Priority Data

Oct. 11, 1972 United Kingdom ..... 46934/72

[52] U.S. Cl. ..... 417/218

[51] Int. Cl.[2] ..... F04B 1/00

[58] Field of Search ..... 417/212, 213, 218, 219, 417/221, 222; 60/452

[56] References Cited

UNITED STATES PATENTS

| | | | |
|---|---|---|---|
| 2,403,371 | 7/1946 | Ifield et al. | 417/218 |
| 2,424,035 | 7/1947 | Ifield | 417/218 |
| 3,063,381 | 11/1962 | Budzich | 417/222 |
| 3,512,178 | 5/1970 | Russell | 417/213 |
| 3,635,021 | 1/1972 | McMillen et al. | 60/450 |
| 3,669,569 | 6/1972 | Wagenseil | 417/222 |
| 3,669,570 | 6/1972 | Himmler | 417/222 |
| 3,768,928 | 10/1973 | Miller et al. | 417/213 |
| 3,820,920 | 6/1974 | Klimaszewski | 417/218 |

*Primary Examiner*—William L. Freeh
*Assistant Examiner*—G. P. LaPointe
*Attorney, Agent, or Firm*—Barnes, Kisselle, Raisch & Choate

[57] ABSTRACT

A hydraulic system including a variable-delivery pump and a pressure compensator having a spring load applied to one end of the compensator spool. Means are provided for applying a force to the other end of the compensator spool proportional to the pressure obtained from a variable pressure-dividing system connected between the pressure line and tank. This pressure dividing system may consist of a pair of restrictors at least one of which is adjustable. Alternatively, it may consist of a spring-loaded check valve between the pressure line and the compensator chamber and a restrictor from the compensator chamber to tank.

5 Claims, 9 Drawing Figures

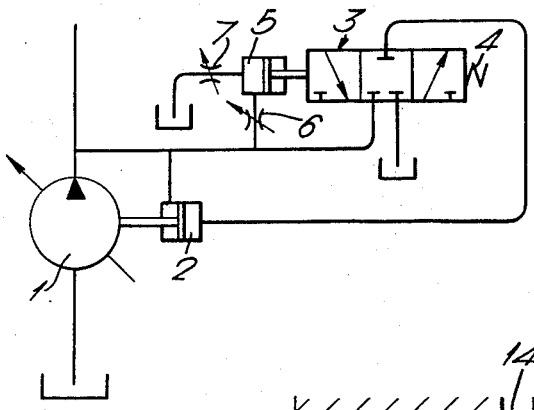
Fig. 1.
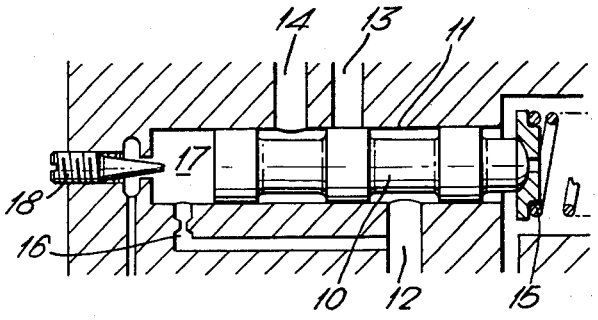
Fig. 2.
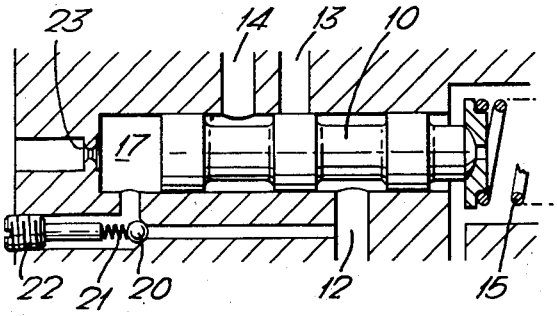
Fig. 3.
Fig. 4.
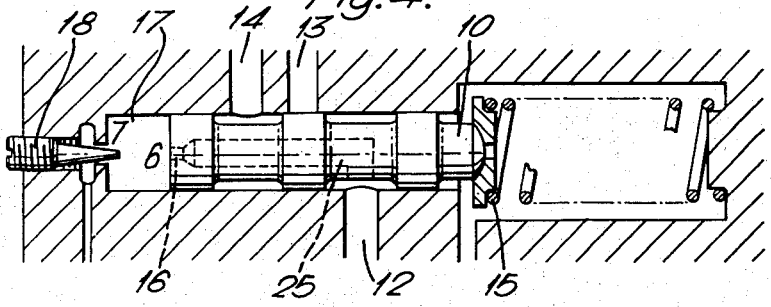

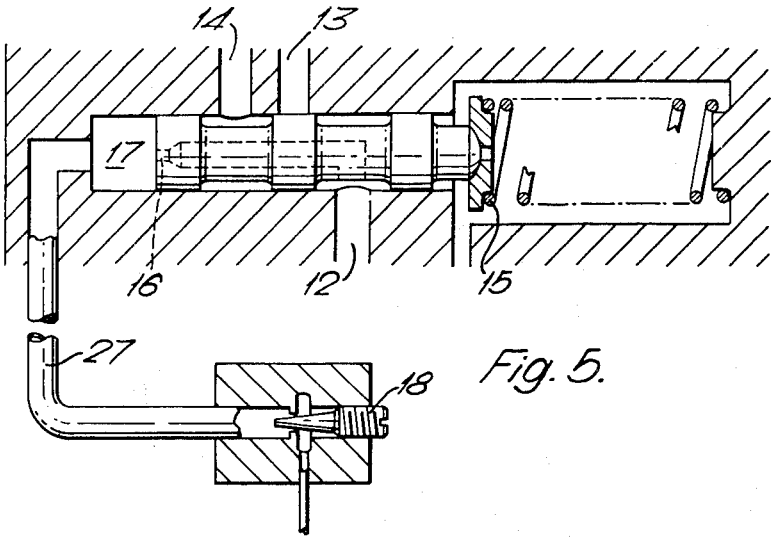
Fig. 5.
Fig. 6.
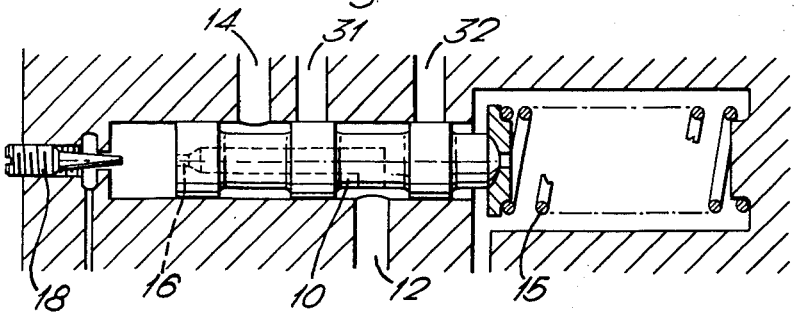
Fig. 7.
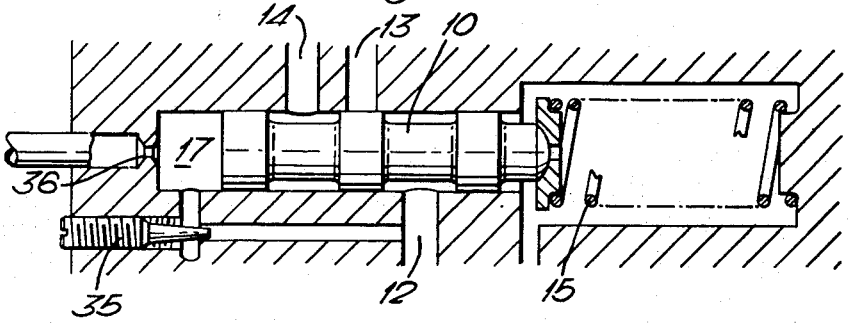

Fig. 8.
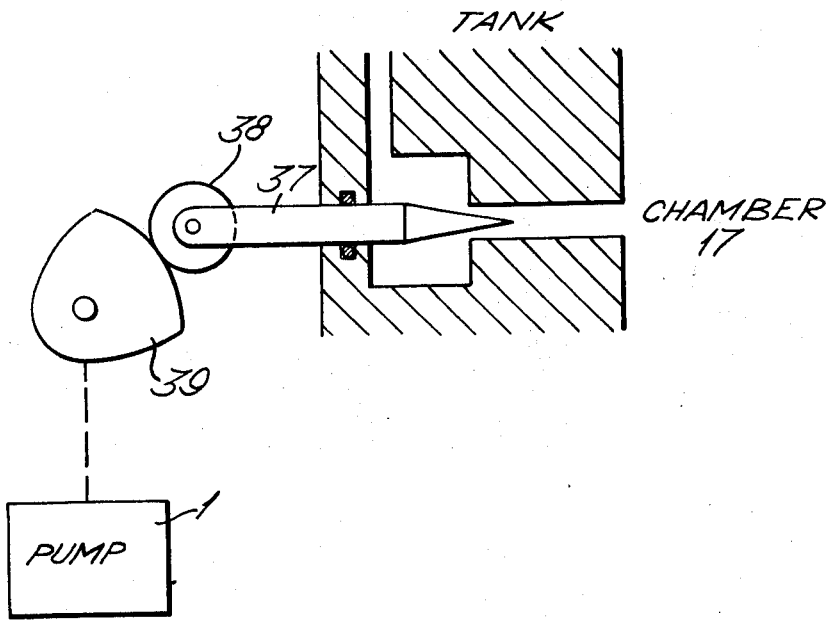
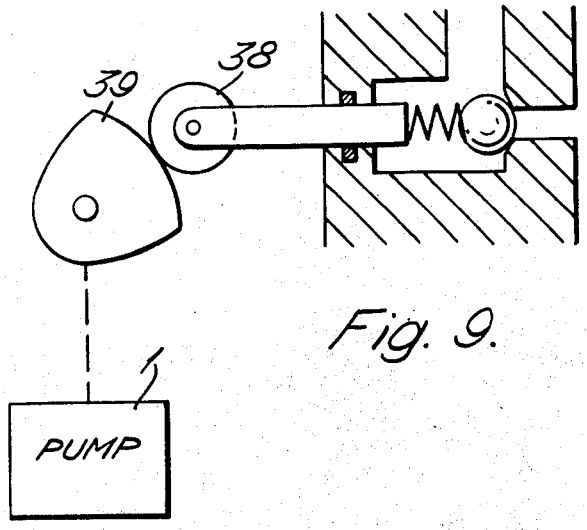
Fig. 9.

PRESSURE CONTROL IN HYDRAULIC SYSTEMS

This invention relates to the control of pressure in hydraulic systems. In an hydraulic system it is essential to limit the maximum pressure generated by the pumping on pressure source. Accordingly if a variable displacement pump is used, means are provided to vary the pump displacement in order to limit or confine the pressure to a constant desired level irrespective of the flow demand.

For this purpose it is usual to provide a pressure compensator which consists of a small spool valve having system pressure applied to one end of the spool and a fixed spring load to the other. Thus the pressure across the spool area gives a load which exactly balances the spring at one particular pressure. When the load from system pressure exceeds that set by the spring, the spool moves to admit hydraulic fluid into a displacement control mechanism in order to reduce pump displacement and thus delivery. When the pressure falls to less than the preset level, the spool moves in the opposite sense, causing the displacement control mechanism to increase the pump delivery.

The relative dimensions of the spool and the spring will, of course, depend on the system pressure to be maintained, and for very high system pressures a powerful spring and small spool are required in the compensator. This makes for a bulky compensator with limitations on valve spool size, gain, sensitivity and response. Furthermore, systems operating at different pressures will require differently-dimensioned compensators, so that it is necessary to manufacture and stock a wide range of different-sized components.

It is an object of the present invention to reduce these disadvantages.

According to the present invention, a hydraulic system includes a variable-delivery pump and a pressure compensator having a spring load applied to one end of the compensator spool, with means for applying a force to the other end of the compensator spool proportional to the pressure obtained from a variable pressure-dividing system connected between the pressure line and tank. This pressure dividing system may consist of a pair of restrictors at least one of which is adjustable. Alternatively, it may consist of a spring-loaded check valve between the pressure line and the compensator chamber and a restrictor from the compensator chamber to tank.

Other forms of pressure reducing valve could also be employed.

The invention will be further described by way of example with reference to the drawings, (FIGS. 1 to 6 of which accompanied the Provisional Specification) in which:

FIG. 1 is a circuit diagram of a hydraulic power supply according to the present invention.

FIGS. 2–7 inclusive are diagrammatic sections through various forms of compensator according to the invention.

FIG. 8 illustrates diagrammatically the application of the invention and pump torque control.

FIG. 9 shows diagrammatically an alternative arrangement.

FIG. 1 shows a circuit diagram of a power supply for a hydraulic system according to the present invention. The power is supplied by a pump 1, which is of the variable delivery type, and the displacement is controlled by means of a piston and linkage, the piston working in a cylinder 2. A compensator 3 is used to control the output pressure at the pump, and consists of a spool valve acted on at one end by a spring represented diagrammatically at 4, and at the other by pressure derived from the output of the pump. This action being represented diagrammatically in FIG. 1 by a cylinder and piston arrangement 5.

According to the present invention, instead of the output line pressure being applied directly at 5 it passes through a restrictor 6 before acting on the compensator, and is bled to tank through a second restrictor 7. One or both of the restrictors 6 and 7 are made variable so that the pressure at 5 is not equal to the output line pressure, but is a fraction of it being dependent on the setting of the restrictors 6 and 7.

In operation, when the line pressure exceeds a predetermined level set by the spring 4 and the setting of the restrictors 6 and 7, the compensator spool moves to the right, exhausting fluid above the piston in the cylinder 2 to tank, and reducing the displacement. If the pressure is too low the compensator spool moves to the left, admitting fluid at pressure to the cylinder 2, and increasing the swash angle. Because only a fraction of the output line pressure is being applied to the compensator by reason of the restrictors 6 and 7, the spring may be made smaller, or the compensator spool larger, than would otherwise be required. Furthermore, the same components of spring and compensator spool and cylinder may cover a very wide range of required pressures by suitably varying the restrictors.

It may be pointed out that either of the restrictors 6 and 7 may be made variable, and the characteristics of the two arrangements are different. If the restrictor 6 is variable and the restrictor 7 is fixed, the leakage rate is constant at various levels of output pressure. On the other hand, if the restrictor 6 is fixed and the restrictor 7 is variable, the leakage rate, and also the response, increase at higher pressures.

In a modification the restrictor 6 may be replaced by a spring-loaded check valve, the restrictor 7 then being fixed. With this modification the outlet pressure is controlled by the summed effect of the check valve spring and the compensator spring.

Referring now to FIG. 2, the figure shows a section through one design of compensator for use in a system according to the invention. The compensator comprises a spool 10 working in a cylinder 11 having an inlet port 12 for connection to the outlet line from the pump, a port 13 for connection to the swash control cylinder of a swash plate pump, and a port 14 vented to tank. A spring 15 acts on one end of the spool 10, and the other end is acted on by fluid admitted from the port 12 through a fixed orifice 16 to the space 17 at the end of the spool 10. This space in turn is vented to tank through a variable orifice formed by a coned screw 18. Raised lands on the spool 10 connect the port 13 to the supply from the pump at the port 12 when the spool moves to the left under the pressure exerted by the spring 15 and to tank by port 14 when the pressure in the space 17 overcomes the force of the spring 15 and moves the spool to the right.

In operation the spool is initially moved to the left by the spring 15, allowing pump outlet pressure to be transmitted via the ports 12 and 13 to increase the swash angle of the pump. A fraction of this pressure, determined by the relative apertures of the restrictors 16 and 18, appears in the space 17, and when this fraction is sufficient to overcome the force of the spring 15 the port 13 is isolated from the outlet pressure and connected to tank via the port 14 by movement of the spool 10. The compensator thus controls the swash angle of the pump so as to maintain the pressure at 17 at such a value as to counterbalance the spring 15.

FIG. 3 shows a modification of the arrangement of FIG. 2 in which a spring-loaded check valve is substituted for the restrictor 16.

Referring now to this Figure, the valve is generally similar to that described with reference to FIG. 2 and corresponding parts are correspondingly numbered. However, in this valve the supply pressure from the port 12 is led to a check valve comprising a ball 20 urged against a seating by a spring 21. A screw 22 allows the pressure exerted by the spring on the ball to be adjusted. Fluid from the check valve flows into the space 17, and is allowed to escape through a restrictor 23 to tank.

In operation the spool 10 is initially displaced to the left by the spring 15 and fluid pressure at the port 12 is applied to the piston controlling the swash plate by way of port 13. When the line pressure builds up sufficiently to overcome the pressure exerted by the spring 21 and to escape past the ball 20, fluid enters the end space 17 from which it can escape only slowly through the restrictor 23. When a sufficient pressure has built up in this space to overcome the force of the spring 15, the compensator spool 10 moves to the right, cutting off the supply of high pressure fluid to the swash control cylinder and connecting this cylinder to tank by way of the port 14. The compensator therefore controls the line pressure at a level determined by the springs 15 and 21.

FIG. 4 shows an alternative modification of the arrangement shown in FIG. 2. The compensator is of generally similar construction except that in this case the fixed restrictor is incorporated in the compensator spool itself.

The spool 10 is provided with an internal passageway 25 leading from a region opposite the port 12 towards the end space 17 remote from the spring 15. At this end is incorporated the fixed restrictor 16 through which fluid can flow from the port 12 into the end space 17 where it acts on the spool so as to oppose the force of the spring 15.

The operation of this form of the invention is exactly as described above with reference to FIG. 2.

FIG. 5 shows a modification of the compensator of FIG. 4 in which, instead of the variable orifice with its adjusting screw being provided in the end of the compensator itself it is separated from the main body of the compensator to allow for remote control. In this case a fluid pressure line 27 communicates with the space 17, and an adjustable restrictor formed by a screw 18 with a coned head screwed against a seating is provided as a separate unit at a remote point. This enables the compensator setting to be adjusted by the operator at a more convenient position than in the embodiments of FIGS. 2 and 4. The method of operation of this embodiment is as described with reference to FIG. 2.

FIG. 6 is a modified form of compensator generally similar to that of FIG. 4, but arranged to funtion as a four-way valve. In this case the single port 13 is replaced by a pair of service ports 31, 32 which, when the spool 10 is central, are closed by the raised lands on the spool. The ports 31, 32 are connected to opposite ends of the cylinder containing the piston which controls the pump swash angle.

In operation, when the line pressure is lower than the preset value determined by the adjustable orifice 18 and the spring 15, the spool 10 moves to the left putting port 31 into communication with the supply, and connecting port 32 to the tank by way of the drain from the chamber containing the spring 15. When the pressure rises above the preset pressure, the spool 10 moves to the right connecting port 31 to tank by way of the tank port 14, and 32 to the pressure line.

This compensator can also be arranged for remote control as described with reference to FIG. 5.

FIG. 7 shows a compensator similar to that of FIG. 2 but with the positions of the fixed and variable restrictors interchanged. In this case the supply line port 12 communicates with the space 17 through a variable restrictor formed by a screw 35 having a coned end arranged to screw towards a seating. The space 17 is vented to tank through a fixed restrictor 36.

The operation of this compensator is as described with reference to FIG. 2, but its characteristic when the variable restrictor is altered differs from that in FIG. 2. In this case the pressure in the space 17, being determined in normal operation by the force of the spring 15, remains constant so long as the compensator is in balance, and therefore the flow rate through the fixed restrictor 36 is independent of the setting of the variable restrictor 35. The sensitivity of the compensator therefore does not depend on the pressure which it is set to maintain, in distinction from the arrangement in FIG. 2 in which the sensitivity is higher at higher pressures.

This compensator can also be arranged for remote control as described with reference to FIG. 5, but of course two lines will be required to the variable restrictor, one leading from the supply line, and the other back to the space 17.

Any of the above arrangement may be easily adapted to provide a simple means for limiting the pump torque. To do this, the adjusting screws of the variable restrictors or of the check valve spring are replaced by plungers coupled to the pump pintle so as to vary the compensator pressure setting in accordance with the pump displacement. The coupling may be by a linkwork or a cam, and by suitably designing the linkwork, or shaping the cam, the pressure setting may be caused to vary inversely with the pump displacement, thus maintaining the pump torque substantially constant.

This arrangement will be further described with reference to FIGS. 8 and 9 of the drawings. Referring first to FIG. 3, a plunger 37 carrying a restrictor needle is substituted for the restrictor screw 18 of FIG. 2. This plunger carries a cam-follower 38 bearing on a cam 39 which is coupled to the pintle of the pump 1. The position of the plunger 37, and therefore the opening of the restrictor and consequently the pressure set by the compensator, are all functions of the pump displacement, determined by the contour of the cam. By suitably shaping the cam the pressure may be caused to vary inversely with displacement, so maintaining the pump torque constant.

Referring to FIG. 9, the screw 22 of FIG. 3 is replaced by a plunger 40 carrying a cam-follower 38 bearing on a cam coupled tp the pump pintle. As described with reference to FIG. 7, the cam 39 may be so shaped as to maintain the pump torque constant.

I claim:

1. A hydraulic system including a variable delivery pump drawing fluid from a sump and supplying it under pressure from the pump outlet, and having an actuating cylinder controlling the pump delivery, a load connected between the pump inlet and the sump, a pressure compensator supplying fluid to said actuating cylinder, the compensator having a compensator spool, spring means applying a force to one end of said compensator spool, a variable pressure dividing system connected between the pump outlet and the sump so as to be in parallel with the load, and means for applying a force to the other end of the compensator spool proportional to the pressure obtained from said variable pressure-dividing system, said pressure-dividing system comprising a pair of restrictors connected one between the outlet and the compensator and the other between the compensator and the inlet, at least one of the restrictors being variable.

2. A hydraulic system according to claim 1, in which one of the restrictors is a fixed restrictor and is incorporated in the compensator spool.

3. A hydraulic system according to claim 1, in which the adjustable restrictor is coupled to the pump so that the compensator varies the pump setting in such a way as to limit the torque at the pump.

4. A hydraulic system including a variable delivery pump drawing fluid from a sump and supplying it under pressure from the pump outlet, and having an actuating cylinder controlling the pump delivery, a load connected between the pump inlet and the sump, a pressure compensator supplying fluid to said actuating cylinder, the compensator having a compensator spool, spring means applying a force to one end of said compensator spool, a variable pressure-dividing system connected between the pump outlet and the sump so as to be in parallel with the load, and means for applying a force to the other end of the compensator spool proportional to the pressure obtained from said variable pressure-dividing system, said pressure-dividing system comprising an adjustable spring-loaded check valve connected between the pressure line and the compensator and a restrictor between the compensator and the inlet.

5. A hydraulic system according to claim 4, in which the adjusting element of the check valve is coupled to the pump so that the compensator varies the pump setting in such a way as to limit the torque at the pump.

* * * * *